United States Patent [19]

Cocca

[11] 4,242,660

[45] Dec. 30, 1980

[54] THICK FILM RESISTORS

[75] Inventor: Theodore F. Cocca, Everett, Mass.

[73] Assignee: Raytheon Company, Lexington, Mass.

[21] Appl. No.: 37,201

[22] Filed: May 8, 1979

[51] Int. Cl.[3] ..... H01C 10/00

[52] U.S. Cl. ..... 338/195; 338/309; 338/320; 338/325

[58] Field of Search ..... 338/195, 307-309, 338/61, 260, 320, 325; 29/620; 427/101-103, 123

[56] References Cited

U.S. PATENT DOCUMENTS

| | | | |
|---|---|---|---|
| 4,041,440 | 8/1977 | Davis et al. | 338/195 |
| 4,146,867 | 3/1979 | Blangeard et al. | 338/308 X |
| 4,172,249 | 10/1979 | Szwarc | 338/308 X |

*Primary Examiner*—C. L. Albritton

*Attorney, Agent, or Firm*—Philip J. McFarland; Joseph D. Pannone

[57] ABSTRACT

Thick film resistors, particularly useful as elements in a resistive voltage divider on a common substrate, are shown to consist of pluralities of substantially identical segments connected in series or in parallel to obtain desired resistance values, each successive pair of such segments being joined through a low resistance connection.

4 Claims, 2 Drawing Figures

THICK FILM RESISTORS

BACKGROUND OF THE INVENTION

This invention pertains generally to electrical resistors and particularly to resistors of such type formed on a substrate.

It is known in the art that great difficulty may be encountered when it is desired to match the temperature coefficients of resistance of so-called thick film resistors. That is to say, when two (or more) thick film resistors having greatly differing values of resistance are formed on a substrate, it is very difficult to obtain resistors with similar temperature coefficients of resistance. Thus, if it is desired to fabricate a resistive voltage divider with a very great difference between the resistances of two resistors making up such a divider, known design techniques cannot be followed to produce an accurate resistive voltage divider for use in applications wherein the ambient temperature may change within wide limits.

Many of the factors which contribute to the difficulty of designing and making satisfactory thick film resistors are known. Thus, it is common practice to use resistive materials having inherently low temperature coefficients of resistance processed under identical conditions and dimensioned so that the physical dimensions of the resistors are as nearly identical as possible. As noted above, however, when the resistances of two resistors must differ greatly, if known design methods are followed, the physical dimensions of the two must differ significantly in some respect with the result that tracking of their thermal coefficients of resistance within close limits may not be achieved.

Another difficulty experienced with any known thick film resistive voltage divider is that, during processing (furnace firing), the mechanism of diffusion may take place at the junctions between the film material and the terminals of the divider. Such a process then causes the value and thermal coefficient of resistance of each thick film resistor to change in accordance with the length of each such resistor. The result, therefore, is that the divider ratio of any known thick film resistive voltage divider may change whenever the ambient temperature changes.

SUMMARY OF THE INVENTION

With the foregoing in mind, it is a primary object of this invention to provide thick film resistors having temperature coefficients of resistance which similarly vary, within very close limits, over a wide range of ambient temperatures.

The foregoing and other objects of this invention are generally attained by providing, in a resistive voltage divider, at least two thick film resistors on a common substrate, each one of such resistors being made up of a plurality of substantially identical segments connected in series and in parallel as required to obtain the desired resistance value and thermal coefficient of resistance for each resistor, there being a low resistance connection between each successive pair of segments connected in series or in parallel.

BRIEF DESCRIPTION OF THE DRAWINGS

For a more complete understanding of this invention reference is now made to the following description of the accompanying drawings, wherein.

DESCRIPTION OF THE PREFERRED EMBODIMENT

Figure 1:
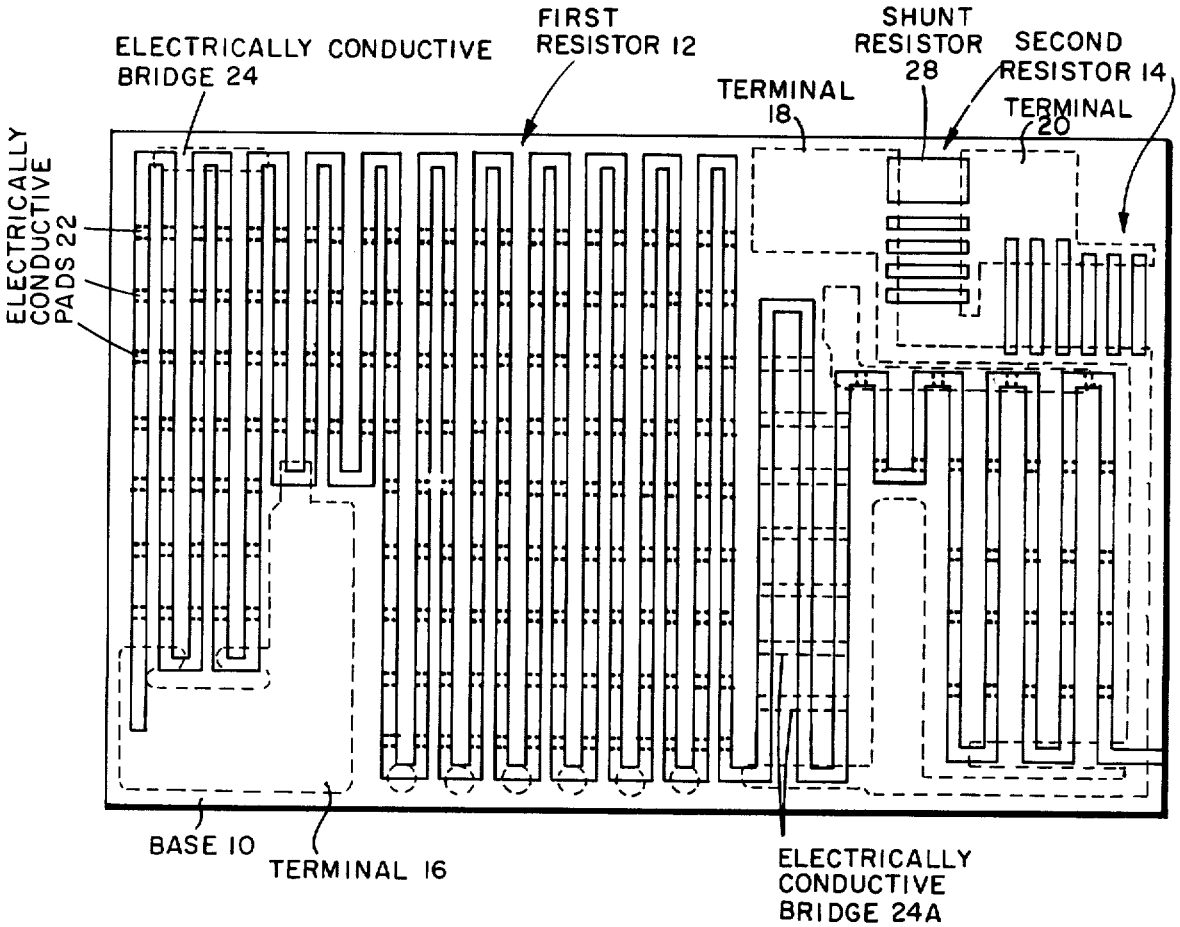
FIG. 1 is a plan view of a thick film resistive voltage divider according to this invention.

Referring now to FIG. 1, it may be seen that the contemplated resistive voltage divider comprises a base 10 supporting a first and a second resistor 12, 14, each made up of a plurality of substantially identical segments (not numbered but shown in full line) connected respectively to terminals 16, 18, 20 (shown in broken line along with other conductive parts). Between each segment (here approximately 0.020 inches wide) of the resistor 12 electrically conductive pads (such as the pads indicated by the numeral 22) are formed so that the greater number of the segments making up the resistor 12 are connected in series. Electrically conductive bridges (such as those indicated by the numerals 24, 24A) are formed between selected ones of the segments making up the resistor 12. Such bridges may, of course, be selectively removed to adjust the resistance of the resistor 12. The terminals 16, 18 and a length of electrically conductive material are shaped to allow the segments making up the resistor 14 to be connected in parallel along with an adjustable shunt resistor 28.

It will now be apparent to one of skill in the art that the illustrated resistive voltage divider may be fabricated in a conventional way. Thus, with a prior knowledge of the desired divider ratio and the desired values of resistance of each resistor a first mask (not shown) may be developed so that the terminals 16, 18, 20, the electrically conductive pads 22 and the electrically conductive bridges 24 may be properly positioned on the base 10. A second mask (not shown) may be developed so that the segments (not numbered) of the resistors 12, 14 and the adjustable shunt resistor 28 may be formed to interconnect the properly positioned terminals 16, 18, 20, the electrically conductive pads 22 and the electrically conductive bridges 24. The absolute values of resistance of the resistors 12, 14 may then be adjusted to obtain the desired divider ratio by opening various ones of the electrically conductive bridges 24, removing one or more segments making up resistor 14 or trimming the adjustable shunt resistor 28.

Figure 2:
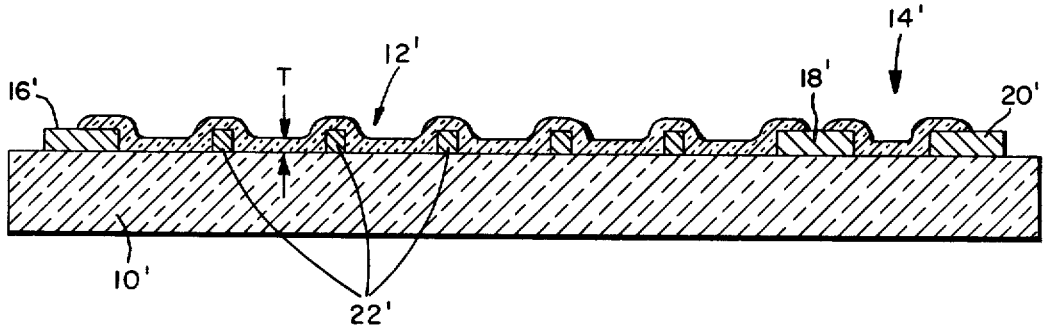
FIG. 2 is a sketch illustrating how the concepts of this invention are followed to render a thick film resistive voltage divider immune to the effects of diffusion, elements corresponding to the identified elements of FIG. 1 being correspondingly numbered with the addition of a prime mark.

Referring now to FIG. 2 it may be seen that the average thickness "T" of the resistive material (here ESL Series 3800 thick film material for resistors manufactured by Electro-Science Laboratories, Inc., 1601 Sherman Avenue, Pennsauken, New Jersey) making up the resistors 12' and 14' is constant by reason of the fact that the electrically conductive pads 22' (here type 9885 conductive material manufactured by E. I. DuPont Company, Dover, Delaware) on the base 10' (here alumina), in effect, divide the resistor 12' into segments equal in length to resistor 14'. As a result, then, because the average thicknesses of the resistors are the same, the physical dimensions of each segment are the same so that the temperature coefficients of resistance are also the same. Futher, it may be seen that any diffusion between the resistive material and an electrically conductive material will (in addition to diffusion adjacent the terminals 16', 18' and 20') occur around each electrically conductive pad 22'. Therefore, the ratio between the absolute values of the resistors 12' and 14' will remain substantially constant.

Having described an embodiment of this invention, it will be apparent that the concepts may be applied to any type of thick film resistors to obtain an improved resistive voltage divider. It is felt, therefore, that this invention should not be restricted to its illustrated embodiment, but rather should be limited only by the spirit and scope of the appended claims.

What is claimed is:

1. A thick film resistor disposed on a substrate between a first and a second terminal, such resistor comprising:

(a) a plurality of similarly shaped electrically conductive pads disposed on the substrate at equal distances between the first and the second terminal; and (b) a thick film resistor in the shape of a strip on the substrate interconnecting the first and the second terminals, such resistor overlying each one of the plurality of similarly shaped electrically conductive pads.

2. A thick film resistor as in claim 1 wherein the plurality of similarly shaped electrically conductive pads divide the strip making up the thick film resistor into substantially equal segments.

3. A resistive voltage divider incorporating thick film resistors disposed on a substrate, such divider comprising:

(a) a first, a second and a third terminal on the substrate;

(b) electrically conductive pads on the substrate at points between the first and the second terminal; and (c) a first and a second thick film resistor of similar cross-sectional shapes interconnecting the first, second and third terminals, the second such resistor connecting the second and the third terminal and the first such resistor connecting the first and the second terminal and overlying the "N" electrically conductive pads at equally spaced points along the length thereof, the overall length of such first resistor being equal to ("N"+1) times the length of the second resistor.

4. The resistive voltage divider as in claim 3 having, additionally, means for adjusting the resistances of the first and the second resistors.

* * * * *